United States Patent [19]

Rommel

[11] Patent Number: 4,506,440

[45] Date of Patent: Mar. 26, 1985

[54] WIRING TOOL FOR WIRING ELECTRIC MULTI-PIN PLUG-IN CONNECTORS, CONNECTOR STRIPS OR THE LIKE USING CLAMP-CUTTING TECHNIQUES

[76] Inventor: Reiner Rommel, Moldaustrasse 6, D-3570 Stadt Allendorf, Fed. Rep. of Germany

[21] Appl. No.: 417,501

[22] Filed: Sep. 13, 1982

[30] Foreign Application Priority Data

Sep. 18, 1981 [DE] Fed. Rep. of Germany ..... 3137209

[51] Int. Cl.[3] ..... H01R 43/04

[52] U.S. Cl. ..... 29/751; 29/566.4; 29/759

[58] Field of Search ..... 29/750–754, 29/759, 566.3, 566.4

[56] References Cited

U.S. PATENT DOCUMENTS 4,286,381 9/1981 Litehizer, Jr. ..... 29/751

4,389,769 6/1983 Casey ..... 29/751

*Primary Examiner*—Carl E. Hall

*Attorney, Agent, or Firm*—Thomas & Kennedy

[57] ABSTRACT

A wiring tool for wiring electric multi-pin plug-in connectors, connector strips or the like has a plunger for pressing a conductor into a cutting clamp provided in a connecting block, whereupon the connecting block is stepped one interpin space at a time after each individual wiring action. To use the wiring tool for processing all types of plug-in connectors, connector strips or the like, without being tied to the existence of special indentations or tongues, the tool also has a feed lever (32), disposed approximately at the level of the access opening for the conductor and projecting into the guide (22) for the connecting block (1), which is moved by an actuating drive (9, 11) of the plunger (28) and which moves the connecting block (1) on by one interpin space after each working stroke of the plunger (28).

6 Claims, 10 Drawing Figures

WIRING TOOL FOR WIRING ELECTRIC MULTI-PIN PLUG-IN CONNECTORS, CONNECTOR STRIPS OR THE LIKE USING CLAMP-CUTTING TECHNIQUES

TECHNICAL FIELD

This invention relates to wiring tools for wiring electric multi-pin plug-in connectors, connector strips or the like.

BACKGROUND OF THE INVENTION

The invention relates to a wiring tool for wiring electric multi-pin plug-in connectors, connector strips or the like using clamp-cutting techniques, in which the electric conductors to be connected are pressed by a plunger transversely with respect to their longitudinal axis into a cutting clamp provided in the connecting block, the said cutting clamp acting to cut through the insulation and to come into contact with the conductor, following which, after each individual wiring action, the connecting block or the connector strip is stepped on one interpin space at a time. Such plug-in connections using a clamp-cutting technique have already been standardized by DIN 41,611 and are used for producing solderless electric connections. The wiring tools commonly used for producing such connections have the disadvantage that a special wiring tool is necessary in each case for every type of plug-in connector or connector strip, or the connecting blocks used must be provided with special indentations or the like so that they can be used in the wiring tool which is adapted to fit only them.

It is the object of the invention to simplify and to reduce the cost of the production of solderless electric connections using the clamp-cutting technique and to create a wiring tool which can be used for use with all types of plug-in connectors, connector strips or the like without being tied to the existence of special indentations or tongues and which in the simplest manner permits the tool to be adapted to all existing connector and conductor sizes and shapes.

SUMMARY OF THE INVENTION

According to the invention, this object is achieved by an arrangement wherein a feed lever, which is arranged approximately at the level of the access opening for the conductor and projects into the guide for the connecting block, steps the connecting block on by one interpin space after each working stroke of the plunger, the feed lever being moved by the actuating drive of the plunger. An important factor in this arrangement is that the feed lever engages the connecting block from the open side of the cutting clamps by being mounted to be pivotable around an axis which is provided at right angles to the direction of displacement of the connecting block adjacent to the plunger, and during its movement corresponding to the foward stroke of the plunger, steps with its front end elastically over the partition provided between the individual cutting clamps in the connecting block and during the opposite movement engages behind the respective partition and by this action moves the connecting block on by one interpin space.

It is of particular advantage to provide the feed lever with an elastic rest which slides over the open side of the connecting block or the cutting clamps.

A further advantage is given by the fact that the wiring tool is provided with a part which accommodates the handle together with the actuating drive, and to which a plurality of interchangeable heads can be attached corresponding to the various sizes of the connecting blocks to be processed. In this arrangement each interchangeable head intended for individual wiring is provided with a plunger for the connector and the feed lever which works in conjunction with the plunger for the connecting block, the plunger drive being formed by a piston guided in the handle.

In order to make the tool usable for ribbon connectors, a knuckle joint drive for actuating the piston with the respective required pressing power is provided in the handle.

Further details of the wiring tool according to the inventions are explained in the description which follows and can be seen in the attached drawings.

DETAILED DESCRIPTION

Figure 1:
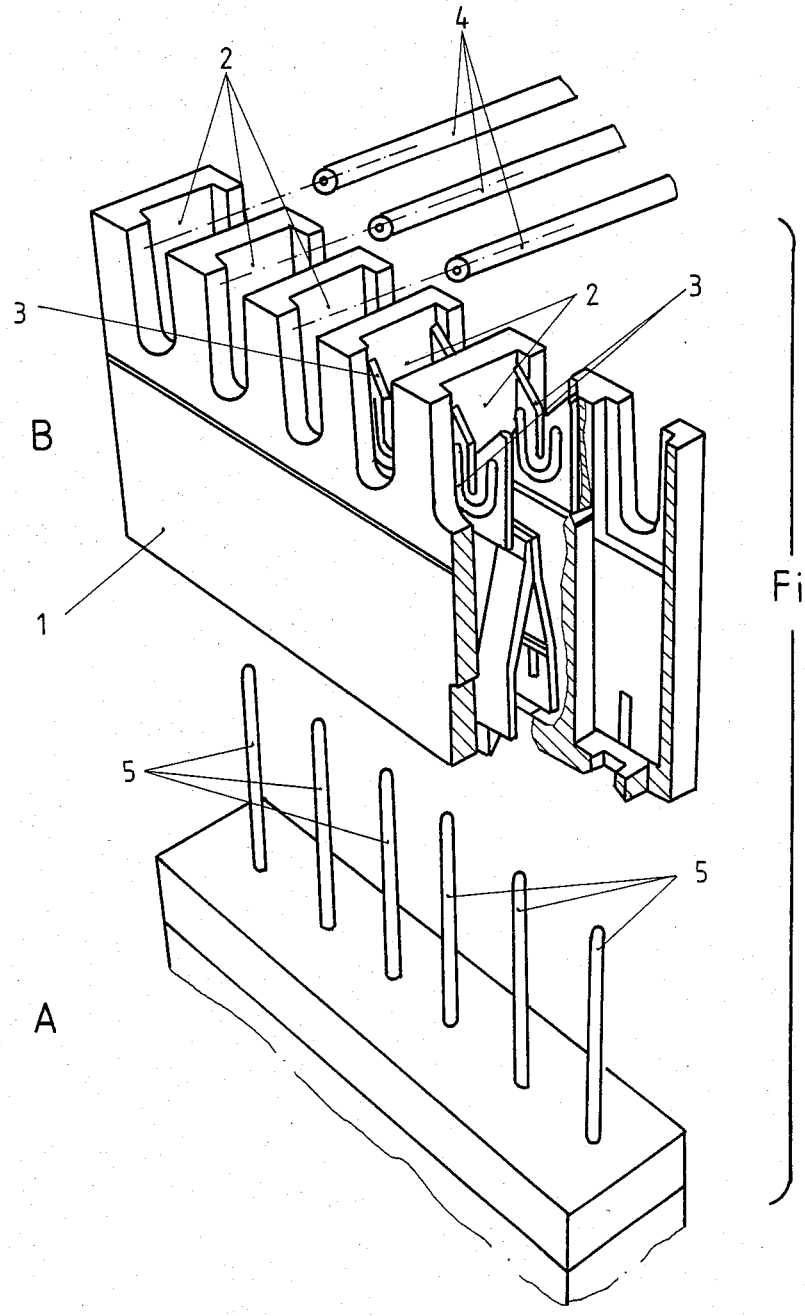
FIG. 1 shows a diagrammatic perspective view of a multi-pin plug-in connector for the purpose of explaining the clamp-cutting technique.
Figure 4:
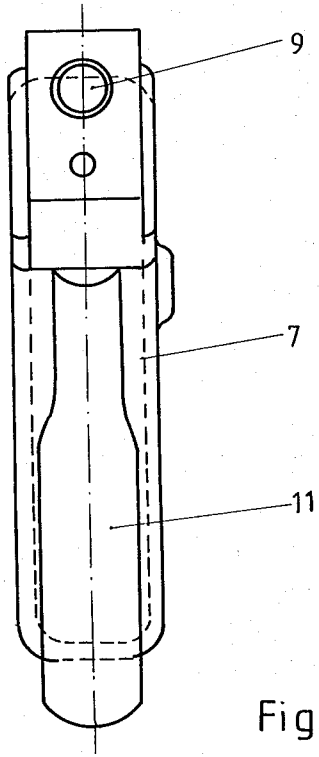
FIG. 4 shows a front view of the handle.
Figure 2:
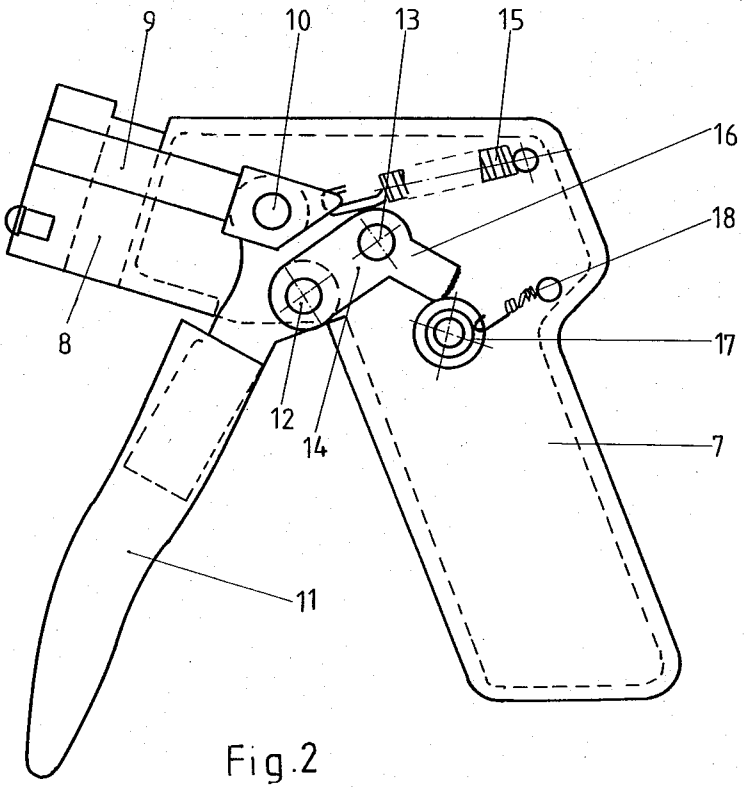
FIGS. 2 and 3 show a side view of the handle with the actuating device in various working positions.

According to FIG. 1, the plug-in connector consists of the parts A and B, adjoining cells 2 being provided in the connector body 1, in each of which cells one cutting clamp 3 is accommodated, into which the individual insulated electric conductors 4 are pressed consecutively, transversely with respect to their longitudinal orientation. The bottom of the connector body 1 is provided at the level of the cells 2 with openings for introducing the connector pins 5, for the contacting of which clamping springs 6 are provided in each cell 2 which are conductively connected to the cutting clamps 3. The conductor connections for the connector part A can be produced in the same way be means of cutting clamps.

In order to wire the plug-in connector, the wiring tool is used which is shown in FIGS. 2, 3, 4, 5, 6, 7, 8, 9 and 10. This essentially consists of a hollow handle 7, the front of which passes into a mount 8, pointing obliquely upwards, into which the varied interchangeable heads according to FIGS. 5, 6, 7, 8 and 9 can be inserted. A piston 9 passes longitudinally through the mount 8 and is connected in an articulated manner inside the handle 7 via a pivot pin 10 to a hand lever 11. The hand lever is connected via a pin 12 to a knuckle lever 14 mounted on the axle 13. The lever 11, 14 is pulled back into its release position according to FIG. 2 by means of a tension spring 15 which engages the piston 9. The knuckle lever 14 is provided with a tooth segment 16 which works in conjunction with a well known type positive lock 17, 18 in a manner such that the actuating piston 9 returns to its initial position only after a complete working stroke.

As has been mentioned before, the varied interchangeable heads according to FIGS. 5, 6, 7, 8 and 9 can be mounted on the mount 8 of the handle 7. In the present example, the interchangeable heads 20 are provided with a guide 21 which can be pushed onto the mount 8 of the handle 7 from above, and a hole 23 which passes through the whole length, for accommodating the piston 9. In the front part of the interchangeable head a guide 22, which is open to the top and which runs across the head, is provided into which the connecting body 1, which has only been drawn in dashes in FIG. 7, can be inserted in the direction of the arrow. The hole 23 provided in the interchangeable head continues in another guide 24 which becomes a vertical slot 25. In the guide 24 a short piston 26 is guided which is provided with a vertical pressure plate 28 which has a slot 27 and extends forward and which is intended for the purpose of pressing the conductor 4 into the respective cutting clamp of the connecting block. On the side of the piston 26 a projection 29 is located which acts as a support for a compression spring 30 such that the piston 26 will always return to its end position at the rear.

Mounted on a vertical pin 31, adjacent to the guide slot 27 for the pressure plate 28, is the feed lever 32 according to the invention, the front end of which is provided with a nose 33 which is elastic in itself and by means of which it projects into the guide 22 for the connecting block 1. The feed lever 32 projects by means of a lateral projection 34 through the slot 27 of the pressure plate 28.

Figure 7:
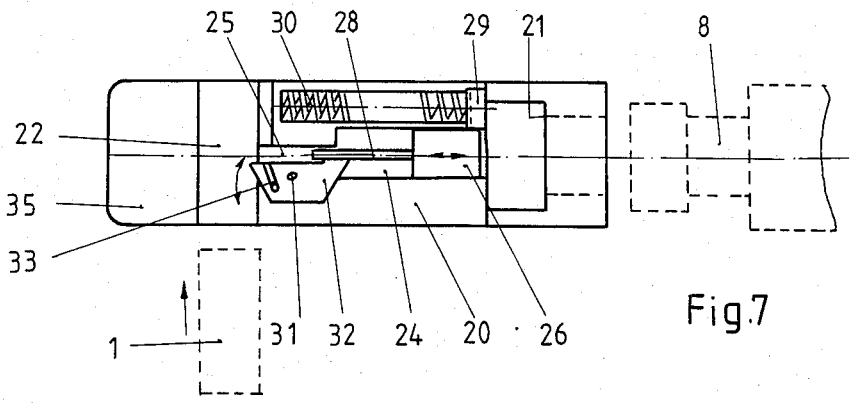

In the rest position, the feed lever 32 is located in the position according to FIG. 7. The nose 33 projects elastically only a little into the guide 22. The piston 26 is in its rear position under the action of the spring 30. At this stage the projection of the feed lever 32 is located in the front end of the slot 27. If now the piston 9 is pressed forward by means of the actuating lever 11 the piston 26 and the plate 28 are pushed forward. This is the working stroke by means of which the conductor 4 is pressed into the cutting clamp. The feed lever 32 is moved into the position of FIG. 6 only in the last portion of the working stroke when the nose 33 steps elastically over the partition 2 provided between the individual cutting clamps of the connecting block 1.

Only after the conductor 4 has been correctly pressed into the cutting clamp 3 will the positive lock 17, 18 permit the hand lever 11 to swing back. This releases the piston 26 so that it can be pressed by the compression spring 30 out of the position of FIG. 6 into the position of FIG. 7. As soon as the lateral projection 34 on the feed lever 32 arrives at the front end of the slot 27, the feed lever 32 is rotated clockwise and the projecting elastic nose 33 comes into contact with the partition of the connecting block and pushes the connecting block on by one interpin space. In this manner the individual conductors 4 can be pressed, one after the other, into one cutting clamp each provided for this purpose.

Figure 10:
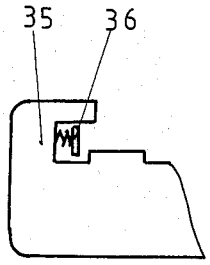
FIG. 10 shows an individual representation of a different embodiment of the work piece support in the interchangeable head.
Figure 5:
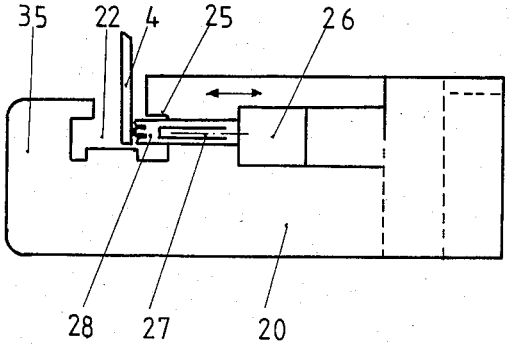
FIGS. 5, 6 and 7 show one of the interchangeable heads which can be attached to the handle, for carrying out individual wiring actions with automatic stepping.
Figure 6:
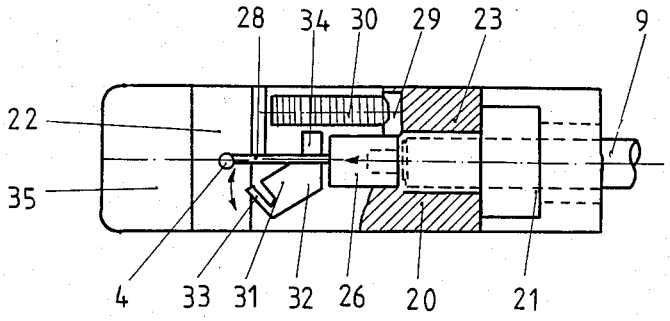

In the cycle of work described above the connecting block 1 inserted in the interchangeable head 20 is supported by the thrust support 35 formed in the interchangeable head. In order to achieve an elastic support, a spring-loaded bearing plate 36 can also be provided in the thrust support 35 as shown in FIG. 10. In this case, the feed lever 32 does not need to be elastic in itself.

Figure 8:
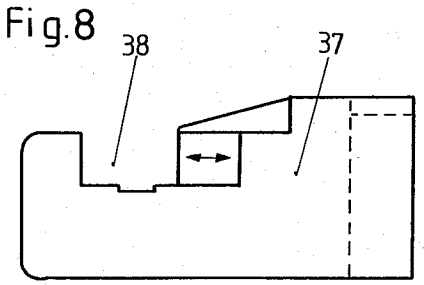
FIGS. 8 and 9 show a top and side view of an interchangeable head for processing ribbon conductors.
Figure 9:
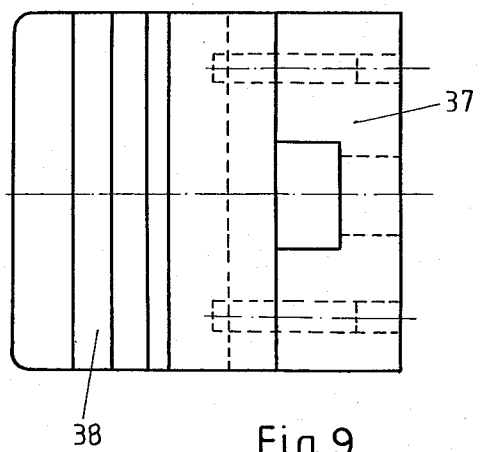
Figure 3:
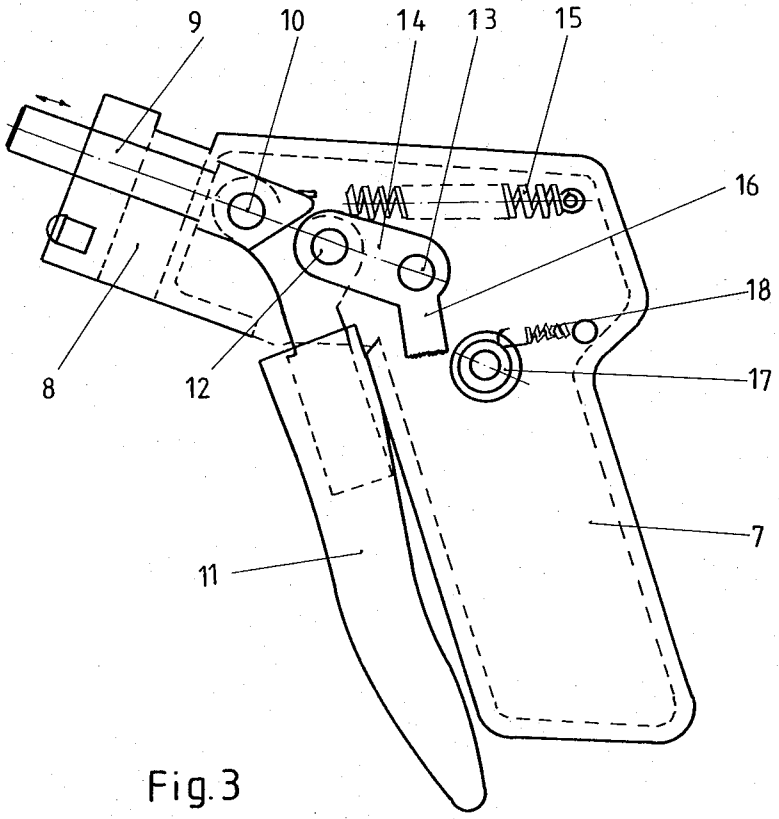

If instead of individual wiring a ribbon cable is to be connected to a plug-in connector, an interchangeable head as shown in FIGS. 8 and 9 must be attached to the handle 7. Such an interchangeable head 37 is provided with a guide 38 for the connecting block. In this case a feed lever, complete with drive elements, as described before, is completely omitted. The increased pressing power required for pressing in ribbon cable connections is supplied without difficulty by the knuckle lever drive 10, 11, 12, 13 and 14.

Naturally, all types and sizes of interchangeable heads for individual wiring and interchangeable heads for ribbon connections can be attached to the handle 7 in the simple manner described.

I claim:

1. A wiring tool for wiring an electric connector of the type having a series of cells bounded by cell walls within each of which a wire clamp is mounted, and with the tool comprising, in combination, a head removeably mountable to a handle, a guide slot formed in said head for slideably receiving an electric connector, plunger means mounted for reciprocal movement through said head toward and away from said guide slot along a path of travel for pressing an insulated wire of an array of wires into a cell clamp of an electric connector located in said guide slot; means for reciprocally driving said plunger along said path of travel; and feed lever means pivotably mounted to said head about an axis located beside said path of travel and beside said guide slot and responsive to movement of said plunger means to move into engagement with a cell wall of a cell that is to receive an insulated wire for stepping the connector along said guide slot so as to position another cell clamp along said path of plunger travel.

2. A wiring tool for wiring electric multi-pin plug-in connectors of the type including a series of cell walls defining a series of cells and a cutting clamp positioned in each cell wherein an insulated wire is presented in front of a cell and is thrust in a direction normal to its length into the cell and is cut and clamped by the cutting clamp in the cell, said wiring tool comprising a head mountable to a handle and defining a guide slot for slideably receiving an electric connector, a plunger reciprocably supported by said head and moveable along a path that intersects said guide slot for thrusting an insulated wire into a cell of an electric connector located in said guide slot, a feed lever pivotably mounted to said head about an axis displaced from alignment with said path and from alignment with said guide slot, said lever having a lateral projection moveable in response to the movement of said plunger and a nose portion thereof moveable in an arcuate path in said guide slot for engagement with the cell walls of an electric connector in said guide slot to urge the electric connector to slide through said guide slot, whereby the electric connector is progressively stepped through the guide slot in response to each reciprocation of the plunger.

3. The wiring tool of claim 2 and wherein said nose portion of said feed lever projects elastically into a cell of the electric connector, and wherein said plunger comprises an actuating slot through which said lateral projection of said feed lever projects and which pivots said nose portion in one direction when said plunger is thrusting an insulated wire into the cell of a connector to cause the nose portion to step from one cell to another cell of the connector and which pivots said nose portion in the opposite direction when said plunger is moving away from the cell of the connector to cause the nose portion to move the connector through said guide slot.

4. The wiring tool of claim 2 and wherein said handle includes a mount and wherein said head includes a mount receiving slot for attachment to said mount, and wherein said handle includes a piston aligned with the plunger of the head mounted on said handle, and said handle including lever means for reciprocating said piston.

5. The wiring tool of claim 2 and wherein said head includes a bearing plate for engaging the electric connector positioned in said guide slot, and spring means supporting said bearing plate.

6. A wiring tool for wiring electric multi-pin plug-in connectors of the type including a series of cell walls defining a series of cells and a cutting clamp positioned in each cell wherein insulated wires are thrust in a direction normal to their length into a cell and are cut and clamped by the cutting clamp in the cell, said wiring tool comprising a head mountable to a handle and defining a guide slot for slideably receiving an electric connector, a plunger reciprocably supported by said head and moveable along a path that intersects said guide slot for thrusting an insulated wire into a cell of an electric connector located in said guide slot, a feed lever mounted to said head, said lever having a lateral projection moveable in response to the movement of said plunger and a nose portion moveable in said guide slot for engagement with the cell walls of an electric connector in said guide slot, said nose portion of said lever being moveable in one direction along said guide slot to step from one cell to another cell of an electric connector in the guide slot as the plunger urges an insulated wire into a cell of the electric connector and moveable in the opposite direction along said guide slot to move the electric connector along the guide slot to present another cell to the plunger as the plunger moves away from the electric connector.

* * * * *